United States Patent [19]

Wilson et al.

[11] 4,375,774

[45] Mar. 8, 1983

[54] ADJUSTABLE PUNCH HEAD

[75] Inventors: Kenneth J. Wilson, Roseville; Ronald G. Rosene, Anoka, both of Minn.

[73] Assignee: Wilson Tool Company, White Bear Lake, Minn.

[21] Appl. No.: 294,977

[22] Filed: Aug. 21, 1981

Related U.S. Application Data

[63] Continuation of Ser. No. 107,880, Dec. 26, 1979, abandoned.

[51] Int. Cl.[3] ..... B26F 1/14

[52] U.S. Cl. ..... 83/140; 83/700

[58] Field of Search ..... 83/138–143, 83/146, 700, 640, 136, 145

[56] References Cited

U.S. PATENT DOCUMENTS

| | | | |
|---|---|---|---|
| 2,355,344 | 8/1944 | Wales | 83/640 X |
| 2,708,970 | 5/1955 | Taylor | 83/140 |
| 2,882,971 | 4/1959 | Bennett et al. | 83/140 |
| 3,205,742 | 9/1965 | Williamson | 83/140 |
| 3,342,091 | 9/1967 | Schott et al. | 83/140 |
| 3,446,105 | 5/1969 | Herzug | 83/146 |
| 3,935,771 | 2/1976 | Cady, Jr. | 83/140 |
| 4,031,787 | 6/1977 | Cady | 83/140 |

OTHER PUBLICATIONS

Standard Tooling Used on Strippit Fabri-Center and Semi-Automatic Fabricators, Issue 7503, pp. 6-3-6-6, Part No. 200213-000, 3½" Stripping Guide Assembly, Strippit Division, Houdaille Industries, Inc.

*Primary Examiner*—Frank T. Yost

*Attorney, Agent, or Firm*—James R. Haller; Steven G. Parmelee

[57] ABSTRACT

A punch assembly having a punch head adjustably connected to a punch drive. By manipulation of this adjustment and by measuring only the length of the punch unit from the punch head to the tip of the punch tip, the operator may guarantee that when the punch unit is placed within a punch guide in a nonpunching position, the punch tip will be properly recessed within the punch guide.

7 Claims, 4 Drawing Figures

ADJUSTABLE PUNCH HEAD

This application is a continuation of application Ser. No. 107,880, filed Dec. 26, 1979, now abandoned.

TECHNICAL FIELD

This invention relates general to punch assemblies such as those usable with multiple station turret punch machines.

BACKGROUND ART

Multiple station turret punch machines such as the Amada Lyla Series Model 50-50-72 can provide up to 72 different punch stations for use in conjunction with a like number of opposing die surfaces. In such a machine, each punch station includes a punch unit and a punch guide. The punch unit includes a punch tip having an edge formed thereon for punching through a metal worksheet. During use, however, the punch tip will become dulled. Rather than disposing of the punch tip and replacing it with a new one, economics have dictated that the punch tip be ground to a new edge and reused.

When grinding a punch tip, however, the overall length of the punch tip will be reduced. Since the distance between the cutting edge of the punch tip and the worksheet constitutes a critical dimension in punching operations, the operator must compensate for the shortened punch tip length.

Punch tips are generally separable from the punch driver body. Therefore, many operators compensate for the shortened punch tip length by placing spacers between the punch tip and the punch driver, thereby increasing the overall length. The accuracy of this time-consuming method will be limited by the available widths of spacer materials. Furthermore, this method may require an undue degree of trial and error before the most nearly correct combination of spacers are discovered.

By another method, the punch assembly has a built-in adjustment plug. Part No. 200213-000, 3½ stripping guide assembly as manufactured by the Strippit Company represents one such assembly. With these assemblies, however, the operator must make at least two calibration measurements while adjusting the punch tip length. That is, he must measure both the overall length of the punch unit and of the punch assembly. Other disadvantages include the substantial disassembly required to remove the punch tip for sharpening and reinstallment.

Therefore, a need exists for a punch assembly having an adjustable punch head such that punch tip lengths may be easily and accurately adjusted with a minimum of disassembly and by measuring only a single calibration parameter.

DISCLOSURE OF INVENTION

This invention is directed towards a punch assembly having an adjustable punch head assembly for simultaneously adjusting the position of the punch tip with respect to both the punch head and the punch guide.

A cylinder having at least one open end comprises the punch guide of the assembly. The end opposite the open end may be fitted with either an integral or a removable stripper plate. The stripper plate will have an opening disposed therethrough for receiving the punch tip.

The open end of the punch guide includes an outwardly disposed annular shoulder. This end also includes a notch annularly disposed around the interior thereof for receiving and supporting a spring support ring described further below. The punch guide may also include a key positioned on its interior for appropriately interacting with a key pathway provided in the punch driver.

The punch tip of the assembly has a punching face of any desired configuration formed on one end thereof. The opposing end of the punch tip includes an axially disposed tapped opening for receiving a punch tip bolt.

The punch tip also includes two key pathways disposed parallel to the axis of the shank and 90° apart from each other. These key pathways may operably interact with a key affixed to the punch driver.

The punch driver has a lower portion slideably disposable within the punch guide. The upper portion of the punch driver forms a cylinder having a smaller exterior diameter and further having a well formed axially therein for receiving the adjustable punch head assembly described below. This well may be tapped. This well also provides access to a hole disposed axially through the punch driver for receiving a punch tip bolt.

To facilitate proper orientation of the punch tip, the punch driver has a key attached to its lower face by a screw or bolt. Preferably, the key should be attachable on either side of the bolt hole, and two tapped holes are so located to allow such positioning.

The punch driver also includes a key pathway along its outer surface for operable interaction with the key provided in the punch guide. This also assists in ensuring the correct positioning of the punch tip.

To attach the punch tip to the punch driver, the operator positions the key in either of the provided locations. The operator then aligns one of the key paths on the punch tip with the key and slides the punch tip into place. The punch tip and the punch driver may then be attached by inserting a bolt through the punch driver hole and threadably engaging the bolt in the punch tip. It may now be noted that by providing two possible key positions (180° apart), and two key paths 90° apart on the punch tip, the punch tip may be rotated through 90° intervals as desired. This feature becomes particularly important when dealing with punch tips having non-symmetrical or irregular configurations.

The adjustable punch head assembly includes a punch head having a threaded post for mating with the tapped well in the punch driver. The punch head includes a hole disposed axially therethrough for allowing access to the punch tip bolt. The punch head also includes four holes disposed symmetrically about its outer perimeter for receiving screws or bolts to connect the punch head to a spring support ring. These holes may include a head well to allow the head of the screw to be disposed below the upper surface of the punch head. Finally, the punch head has a flange extending about its perimeter for operable interaction with a normally uncompressed spring described below.

The punch head connects to one end of a spring support collar. The spring support collar comprises a cylinder having a spring support shoulder formed about its unattached end, which shoulder may be slideably disposed within the punch guide.

A spring support ring fits slideably about the spring support collar and rests upon the spring support shoulder. The spring support ring exceeds the exterior dimensions of the spring support shoulder, and fits within the notch provided in the open end of the punch guide.

A normally uncompressed spring may be disposed about the spring support collar between the punch head flange and the spring support ring. The spring will be under tension, such that the spring support ring will be forced against the spring support shoulder, therefore urging the punch head away from the spring support ring.

To connect the adjustable punch head assembly to the punch driver, the operator need only mate the threaded post of the punch head with the tapped well in the punch driver. Once properly adjusted, the adjustable punch head assembly may be prevented from rotating with respect to the punch driver by providing an aligned cavity through both members and inserting an expandable locking pin thereto.

When fit within the punch guide, the punch driver and spring support collar may move up and down within the punch guide. When a ram strikes the punch head and urges the punch head downward, the spring will compress between the spring support ring and the punch head flange. Upon removing the ram from the punch head, the spring will urge the punch head upwards to its normal nonpunching position.

To sharpen the punch tip, the operator need only remove the punch unit comprising the adjustable punch head assembly and punch driver combination from the punch guide. The punch tip may then be removed and sharpened. After sharpening, the punch tip may be reconnected to the punch driver as described above. To adjust the position of the punch tip with respect to the punch guide and the punch head, the operator need only turn the adjustable punch head assembly with respect to the punch driver to either increase or decrease the distance between the punch head and the punch tip. Upon completion, the operator may replace the punch unit and resume punching operations.

BRIEF DESCRIPTION OF DRAWINGS

These and other features of the invention will become more apparent upon reference to the following description of the best mode for carrying out the invention, and in particular upon referring to the drawings, wherein.

BEST MODE FOR CARRYING OUT THE INVENTION

Figure 1:
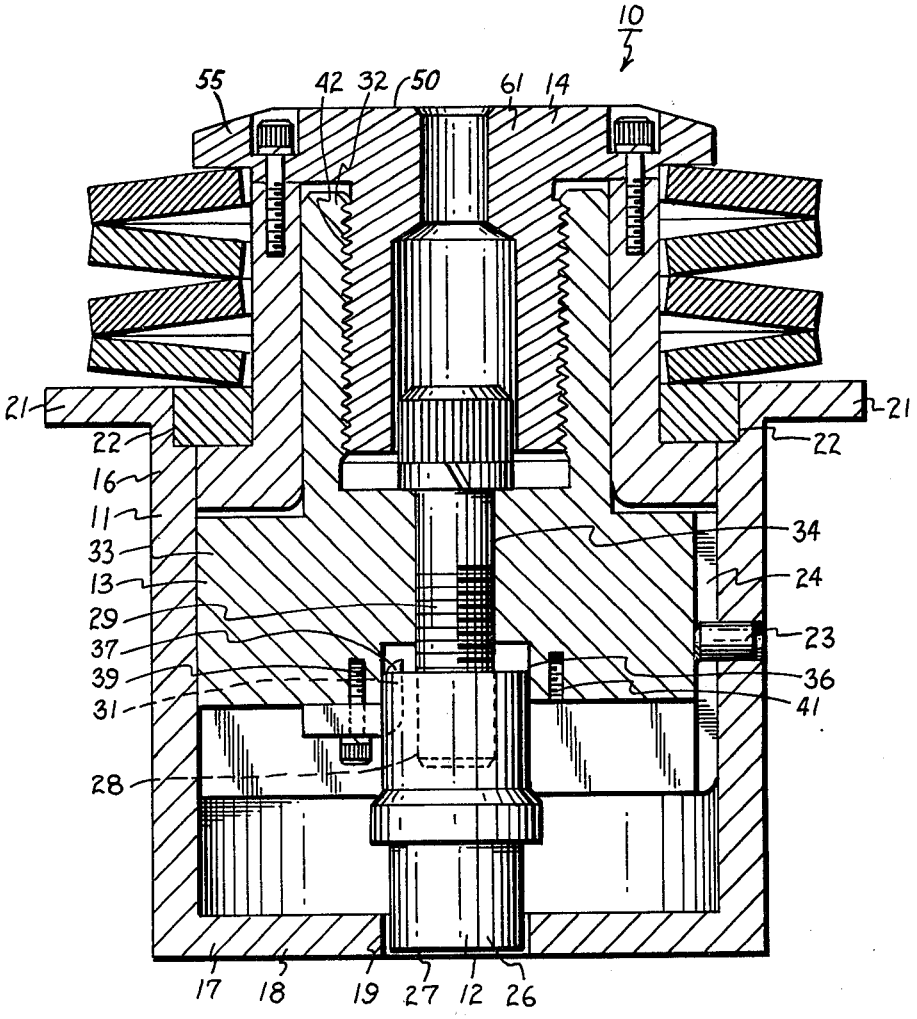
FIG. 1 is a sectioned side elevational view of the invention.

Referring now to the drawings, and in particular to FIG. 1, the apparatus of the invention may be seen as denoted generally by the numeral 10. The apparatus includes generally a punch guide (11), a punch tip (12), a punch driver (13) moveable between upper and lower positions, and an adjustable punch head assembly (14). The apparatus (10) may be made of steel or some other material as might be satisfactorily used in a punch assembly.

The punch guide (11) serves to contain and direct the punch driver (13), and hence, the punch tip (12). A punch guide (11) will typically be cylindrical in shape and have an upwardly facing end (16) opened to receive the punch driver (13). The lower end (17) will be substantially closed by a stripper plate (18) that has a hole (19) disposed therethrough for receiving the punch tip (12). When punching, the punch tip (12) will protrude through the stripper plate (18) and through the work material (not shown) located directly below it. The stripper plate (18) may be removable or it may be made integral to the punch guide (11), as shown.

A spring support shoulder (21) may be formed annularly about the outer edge of the upper end (16) of the punch guide (11). A notch (22) may be recessed annularly about the inside of the punch guide (11) proximal this shoulder. This notch (22) provides a platform for receiving a spring support ring described further below.

The punch guide (11) may also include a key (23) disposed radially inward for operable disposition within a key pathway (24) provided in the punch driver (13), which will also be described in more detail below.

The punch tip (12) may be formed of a shank member (26). One end of the shank (26) has a punch face (27) formed on it. The other end has a tapped hole (28) formed axially therein for receiving a bolt (29). The shank (26) also includes two key slots (31) that are formed parallel to the axis of the shank (26) and to each other. These key slots (31) may be disposed 90° apart from each other around the shank (26). The purpose of this arrangement will be made more clear below.

The punch driver (13) has an upper and a lower portion (32 and 33). The lower portion (33) consists of a substantially solid cylinder having an exterior diameter almost equivalent to the inner diameter of the punch guide (11). Therefore, the lower portion (33) may slide up and down in the punch guide (11), but may not move laterally.

The lower portion (33) also has a hole (34) disposed axially therethrough for receiving the bolt (29) referred to above and a recessed cavity (36) for receiving the punch tip (12). To connect the punch tip (12) to the punch driver (13) the punch tip (12) may be placed in the recessed cavity (36) and a bolt (29) may be disposed through the punch driver (13) and mated with the tapped hole (28) in the punch tip (12).

Figure 2:
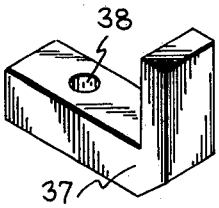
FIG. 2 is an enlarged perspective view of the punch tip key.

To facilitate the proper orientation of punch tips (12) having nonsymmetrical or irregular configurations, a key and slot arrangement may be used. Referring momentarily to FIG. 2, the key (37) may be a substantially "L"-shaped member made of metal, plastic or some other suitable material. The key (37) has a hole (38) disposed through one of its legs for receiving a screw or bolt. To install the key (37) (FIG. 1), the operator selects one of two tapped holes (39 and 41) located on either side of the recessed cavity (36) and connects the key (37) at that location.

With the key (37) in place, one of the two slots (31) on the punch tip (12) must be positioned to receive the key (37). Therefore, the punch tip (12) may not rotate during use since the key (37) will prevent any such rotation. By providing a tapped hole (39 and 41) on either side of the recessed cavity (36), and by providing two key slots (31) as disclosed, the punch tip (12) may be selectively oriented at 90° intervals to accommodate various punch tip face configurations.

Similarly, the lower portion (33) of the punch driver (13) includes a key slot (24) for receiving the key (23) located within the punch guide (11). The punch driver (13) will therefore be restricted to vertical movements, and cannot rotate about its axis. This will also ensure the proper orientation of the punch tip face.

The upper portion (32) of the punch driver (13) has a smaller exterior diameter than the lower portion (33). The upper portion (32) also includes a tapped well (43) formed axially therein for receiving the threaded post of the punch head described below.

Figure 3:
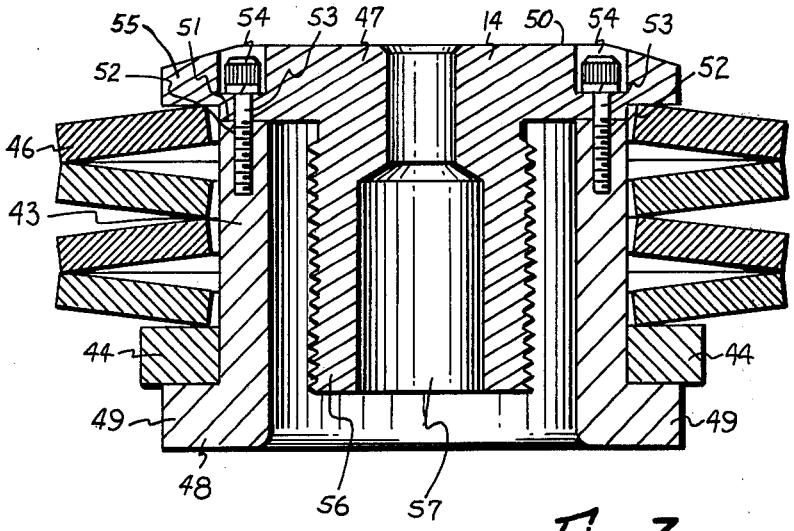
FIG. 3 is a sectioned side elevational view of the adjustable punch head assembly.

Referring now to FIG. 3, the adjustable punch head assembly (14) includes generally a spring support coller (43), a spring support ring (44), a disc spring assembly (46) and a punch head (47).

The spring support collar (43) may be formed of a cylinder having an interior diameter such that it may be snugly fit about the exterior of the upper portion (32) of the punch driver (13). The lower end (48) of the spring support collar (43) has a shoulder or flange (49) disposed annularly thereabout. The shoulder (49) may be slideably inserted in the punch guide (11). The upper end (51) of the spring support collar (43) includes four tapped holes (52) disposed at 90° intervals about the collar (43). These holes (52) are for receiving bolts (53) to secure the punch head (47) to the spring support collar (43), as will be described below.

The spring support ring (44) constitutes a flat ring that may be slideably disposed about the spring support collar (43). The exterior diameter of this ring (44) exceeds the interior diameter of the punch guide (11), and seats in the recessed notch (22) provided therefore at the upper end (16) of the punch guide (11).

A disc spring assembly (46) may be disposed about the spring support collar (43) such that it rests upon the spring support ring (44). In general, such springs are formed of individual rings of spring steel that are formed in a slightly cone-shaped manner, and by alternating their disposition as shown, a normally uncompressed spring may be formed. Although most any form of uncompressed spring could be used, the applicants have determined that such a disc spring works well in this application.

The punch head (47) includes a plate member having four holes (54) disposed therethrough, that may be aligned with the four holes (52) in the spring support collar (43) such that bolts (53) may be disposed therethrough, to affix those two members (43 and 47) together. A flange (55) disposed about the perimeter of the punch head (47) exceeds the exterior diameter of the spring support collar (43), and entraps the spring (46) between itself and the spring support ring (44). The flange (55) and the shoulder or flange (49) thus respectively provide the punch head with constantly spaced upper and lower flanges.

The punch head (47) also includes a threaded post (56) disposed axially downward for threadable engagement with the tapped well (42) in the punch driver (13). The punch head (47) also has a hole (57) disposed axially therethrough to allow access to the punch tip bolt (29) through the punch head.

Figure 4:
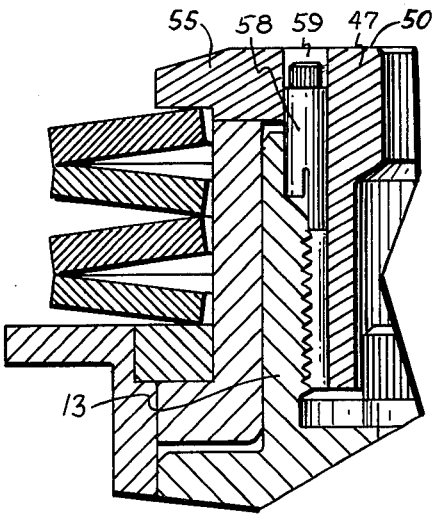
FIG. 4 is a sectioned side elevational detailed view of the invention.

To attach the punch head assembly (14) to the punch driver (13), the threaded post (56) of the punch head (47) may threadably engage the tapped well (42) of the punch driver (13). Having completed this, and referring now to FIG. 4, the operator may prevent the punch head (47) from rotating further about the threaded connection with respect to the punch driver (13) by inserting a nylon expandable locking pin (58) into a cavity (59) provided therefore in both the punch head (47) and the punch driver (13). The locking pin (58) undergoes little fatigue during such use, and may be reused a number of times.

The operation of the apparatus (10) may now be described. When the punch tip face (27) has become dulled through use, the operator may remove the adjustable punch head assembly (14), punch driver (13) and punch tip (12) from the punch guide (11) as a unit (61). By removing the punch tip bolt (29), the punch tip (12) may be removed from the punch driver (13) and sharpened on an appropriate grinding machine. When sharpened, the punch tip (12) may be replaced by properly aligning the key slot (31) with the key (37) and inserting the punch tip (12) into the recessed cavity (36). The bolt (29) may then reengage the punch tip (12) to connect it to the punch driver (13).

After such sharpening, however, the length of the punch unit (61) from the top (50) of the punch head (47) to the punch tip face (27) will be shortened. For the purposes of illustration, assume that the unit (61) should have an overall length of 5.5 inches. When inserted in the punch guide (11), the overall length from the punch head (47) to the bottom of the punch guide (11) should therefore be 5.53 inches, so that the punch tip face (27) will be recessed 0.03 inches. With this apparatus (10), the operator can ensure both an overall punch assembly (10) length of 5.5 inches and a punch unit (61) length of 5.53 inches (thereby ensuring a 0.03 inch recess) by measuring a single calibration parameter.

The operator need only temporarily remove the expandable locking pin (58) from the adjustable punch head assembly (14), and then rotate the adjustable punch head assembly (14) with respect to the punch driver (13) until an overall punch unit (61) length of 5.5 inches is realized. The operator then rotates the adjustable punch head assembly (14) in the shortest direction to again realign the holes (59) provided for the locking pin (58), and reinserts and re-expands the locking pin (58). This will again prevent the adjustable punch head assembly (14) from rotating with respect to the punch driver (13). A high thread density between the adjustable punch head assembly (14) and the punch driver will ensure that little error will be introduced when realigning the locking pin holes (59).

Upon making this single adjustment and by measuring only one calibration parameter, the overall length of the punch unit (61) will be very nearly 5.5 inches. Furthermore, when replaced in the punch guide (11), the overall length of the punch assembly (10) will automatically be 5.53 inches and the length of the punch assembly need not be measured to confirm this fact. Therefore, the punch tip face (27) will be recessed 0.03 inches as desired.

Many changes to the disclosed embodiment will be readily apparent to those skilled in the art. Therefore, while we have described the best mode known for carrying out the invention, it will be understood that various changes, adaptations, and modifications may be made therein without departing from the spirit of the invention and the scope of the appended claims.

We claim:

1. A punch assembly comprising a punch guide having an exterior spring support shoulder, a punch driver carried within the punch guide and moveable axially therein between upper and lower positions during a punching operation, a punch tip carried by the punch driver, a punch head attached to the punch driver and including a top and means defining constantly spaced upper and lower punch head flanges, a spring support ring bearing against the spring support shoulder and against the lower punch head flange when the punch driver with its attached punch head is in its upper position, and a compression spring seated at its upper end against the upper punch head flange and at its lower end against the support ring to render constant the spacing between the punch head top and the spring support shoulder of the punch guide when the punch driver is in its upper position.

2. The improvement of claim 1 wherein said adjustment means constitutes a threaded connection between the punch head and the punch driver.

3. The improvement of claim 1 and further including locking pin means for selectively preventing the adjustment of said adjustment means.

4. A punch assembly comprising a punch guide having an exterior spring support shoulder, a punch driver axially moveable between upper and lower positions within the punch guide, a punch tip carried by the punch driver, a punch head attached to the punch driver and including a top and means defining constantly spaced upper and lower punch head flanges, a compression spring disposed exteriorly about the punch head and seated at its upper end against the upper flange of the punch head, a spring support ring operatively associated with the spring support shoulder and with the lower punch head flange when the punch driver is in its upper position and against which the compression spring seats, the axial length of the compression spring thus being rendered constant between the spring support ring and the upper punch head flange when the punch driver is in its upper position to thus render constant the normal spacing between the punch head top and the spring support shoulder of the punch guide when the punch driver is in its upper position.

5. The punch assembly of claims 1 or 4 including single adjustment means for adjusting the normal axial position of the punch driver and punch tip with respect to the punch guide.

6. A punch assembly comprising a punch guide having an exterior spring support shoulder, a punch driver axially slideable between upper and lower positions within the punch guide and having a threaded annular surface, a punch tip carried by the punch driver, means defining a punch head having a top and an annular threaded surface threadably engaging the annular threaded surface of the punch driver to enable axial adjustment of the punch driver with respect to the punch head, the punch head including means defining constantly spaced upper and lower flanges, a compression spring carried exteriorly about the punch head between the flanges and bearing upwardly against the upper flange, a spring support ring operatively associated with the spring support shoulder of the punch guide and with the lower flange of the punch head when the punch driver is in its upper position and against which the compression spring bears downwardly to render constant the normal spacing between the punch head top and the spring support shoulder of the punch guide when the punch driver is in its upper position, whereby the axial position of the punch tip within the punch guide may be varied by adjusting the axial position of the punch driver with respect to the punch head by means of their respective annular threaded surfaces.

7. The punch assembly of claims 1, 4 or 6 including means permitting the upward removal from the punch guide of a unit comprising the punch head, the compression spring, the punch driver and punch tip.

* * * * *